United States Patent [19]

Gallagher

[11] 4,169,643

[45] Oct. 2, 1979

[54] ELECTRICAL CONNECTOR MATING CLIP

[75] Inventor: David A. Gallagher, Romeoville, Ill.

[73] Assignee: Bunker Ramo Corporation, Oak Brook, Ill.

[21] Appl. No.: 823,389

[22] Filed: Aug. 10, 1977

Related U.S. Application Data

[63] Continuation of Ser. No. 710,762, Jul. 30, 1976, abandoned.

[51] Int. Cl.[2] ..... H01R 13/54

[52] U.S. Cl. ..... 339/75 P; 339/44 R; 339/103 R

[58] Field of Search ..... 339/39, 44 R, 44 M, 339/59 R, 59 M, 75 P, 91 P, 98, 107, 103 R

[56] References Cited

U.S. PATENT DOCUMENTS

| | | | |
|---|---|---|---|
| 3,059,209 | 10/1962 | Bird | 339/75 P |
| 3,425,023 | 1/1969 | Krol | 339/59 R |
| 3,500,292 | 3/1970 | Enright et al. | 339/97 R |
| 3,622,942 | 11/1971 | Rynk | 339/107 |

FOREIGN PATENT DOCUMENTS

| | | | |
|---|---|---|---|
| 713597 | 9/1966 | Italy | 339/39 |

*Primary Examiner*—Roy Lake
*Assistant Examiner*—E. F. Desmond
*Attorney, Agent, or Firm*—William Lohff; F. M. Abuckle

[57] ABSTRACT

A mating clip is provided for use in securing together the mated halves, i.e., a mated receptacle and plug, of a connector. The mating clip is of one piece tubular construction formed from semi-rigid plastic and incorporates inner shoulders which fit grooves of a mated connector. The clip includes a longitudinal hinge integral to the body of the clip and opposite to a slit through the body. The hinge permits the body of the clip to be opened to receive a connector and closed to retain the connector. Latching means are provided in association with the slit to hold the mating clip in its closed state. The spacing of the inner ridges of the mating clip is such that the clip cannot be closed on a connector in place unless the connector is fully assembled so that its grooves mate with the inner shoulder in the clip. The clip prevents extreme flexure or bending of a supported connector. The clip also provides positive retention of connector mating halves and may include extended arms for support of cable ties which provide cable strain relief in alignment with the connector.

13 Claims, 8 Drawing Figures

Fig. 5
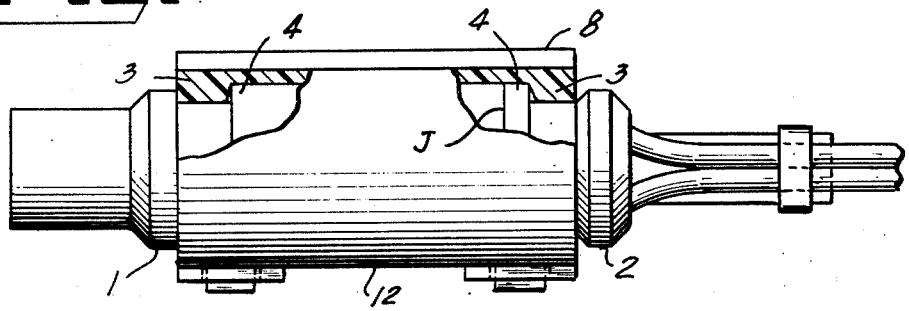
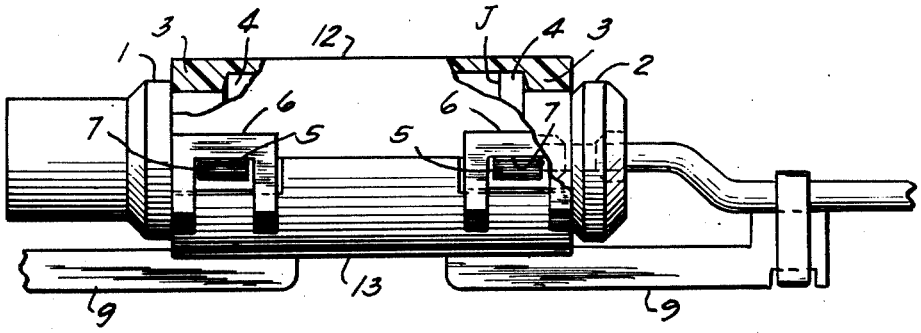
Fig. 6
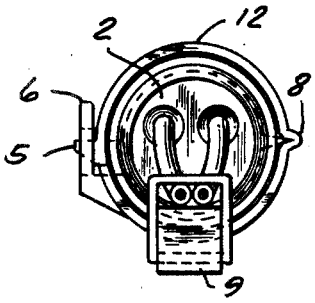
Fig. 7
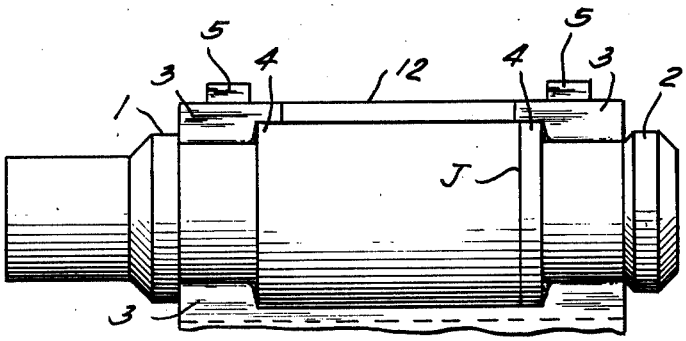
Fig. 8

ELECTRICAL CONNECTOR MATING CLIP

This is a continuation of application Ser. No. 710,762, filed July 30, 1976 now abandoned.

BACKGROUND OF THE INVENTION

1. Field of the Invention

The invention relates to means for receiving and retaining members. It relates further to reception and retention of members which have been assembled from smaller units and to means for assuring that the units have been properly assembled together. It relates particularly to mating clips which may be opened to receive and closed to retain mated electrical connectors. Retaining shoulders associated with the clips and connectors are such that they must be mated positively in a particular way indicative of the completion of good connections before the clips may be closed. The clips are provided with oppositely extending arms for support of cable ties and to provide cable strain relief in alignment with the connector.

2. Description of the Prior Art

Electrical connectors which are mated to complete connections between separate electrical circuits generally consist of plug, or male, and receptacle, or female, parts which are held together by friction after being mated. Such electrical connectors include contact inserts which are frequently made flexible for application to a wide range of circuits including electrical brake circuits and the like and are likely to be damaged if subjected to extreme flexure or bending. With such connectors there is a distinct possibility that a poor connection may be made at the time the parts are mated or that the parts will become partially or completely separated and therefore provide either a poor connection or a complete break in the connections. In some instances, sealing surfaces are provided on the mating insert members for environmental protection and incomplete mating can result in an ineffective seal. Strain on wires or cables leading to the connectors may cause them to be bent causing a deterioration in individual wire seals or in the wires themselves.

Prior art connector housing members have been proposed in accordance with disclosures such as those shown in U.S. Pat. Nos. 3,030,601 and 3,344,393. However, these prior art disclosures have not included means for accepting only mated connector members or for providing a structure of non-elastomeric material with retention shoulders spaced apart a predetermined distance to serve as positive stops against movement of the connector members in an unmating direction. Consequently, they do not enable a determination to be made that connector members are completely mated at the time the housing is applied. Also, they do not provide positive interfaces between the housing and the connector such that the respective parts of the connector will not come unmated after the connector has been installed in the housing. It is noted also that the housings shown in the prior art do not provide a rigid body about the respective connectors to prevent flexible connectors from bending when subjected to bending forces.

SUMMARY OF THE INVENTION

In view of the foregoing, it is an object of the invention to provide an improved mating clip which is of use to receive and hold resilient cylindrical electrical connectors. It is a further object to provide a clip which will prevent extreme flexure or bending of a resilient connector while in a mated condition. It is another object to provide for positive retention of mated connector members. It is yet another object to provide means to confirm whether connector members are fully mated at the time of assembly of the clip. It is still another object to provide means for preventing conductors leading to contacts in the connector from being bent at an extreme angle adjacent to individual wire seals where conductors enter the connector.

To accomplish the foregoing objects and objects ancillary thereto, a device is provided for holding a two part connector together. The device is in the form of a mating clip made of generally rigid or semi-rigid material to provide a relatively stiff axial portion extending over both mated connector members with retention surfaces spaced apart a predetermined distance to engage corresponding surfaces on the connector members and prevent movement of the members in a direction of unmating. The clip includes fastening means for holding the retention surfaces against the connector members with the retention surfaces being spaced apart a predetermined fixed distance for holding only mated connector members. Advantageously, the clip is sufficiently still in an axial direction of the connector members or mated contacts to prevent extreme flexure or bending of resilient connector members and damage to the inserts or contacts in addition to damage to any desired seals between the members. Tapered retention surfaces on clips are also advantageously provided to force the connector members together and improve the completeness of the mating or sealing operation.

In one embodiment, the clip is of tubular construction including a wall with an inner perimeter forming a hollow interior for holding the mated connector members. A slit along the axial length of the wall forms adjacent wall portions which can be separated so that the mated connector members can be inserted in a lateral movement into the hollow interior. The adjacent wall portions are then moved to close juxtaposition and latching means are provided for holding the clip in that closed position.

For holding the connector members in a mated condition, the clip includes axially spaced shoulders arranged as axial stops to be positioned adjacent shoulders on the connector members as the clip is closed about the connector. With connector members sized for a particular clip, the shoulders on the clip are spaced a distance to accept only mated connector members. Advantageously, the shoulders are slightly tapered to develop mating pressures against the connector members as the clip is closed. Latching means are provided to retain the clip in a closed position with individual latches being positioned laterally adjacent the retention shoulders to retain them in the desired positions.

Advantageously, the clip is of one piece construction with an integral hinge formed opposite the axial slit to permit lateral opening and closing of the tubular members. The tubular members also may include axially extending arms on which cable ties can be fastened for strain relief of the conductors.

BRIEF DESCRIPTION OF THE DRAWINGS

The above mentioned and other features and objects of this invention and the manner of obtaining them will become more apparent, and the invention itself will be best understood by reference to the following description of an embodiment of the invention taken in conjunction with the accompanying drawings, in which;

FIG. 5 is a view in elevation of a mating clip according to the invention, showing it in use to secure a connector and wiring to the connector, FIG. 6 is a side view of the mating clip of FIG. 5, FIG. 7 is an end view of the mating clip according to FIG. 6, and FIG. 8 is a view of a portion of a mating clip in its open position showing a connector in position in accordance with the invention.

DESCRIPTION OF PREFERRED EMBODIMENTS

Figure 1:
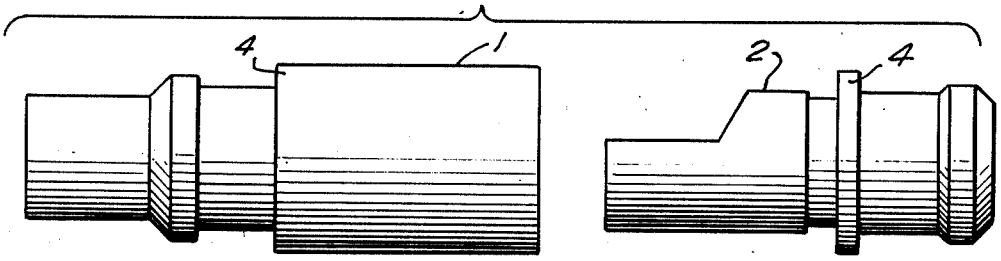
FIG. 1 is an expanded view of a connector of a kind of interest in the practice of this invention.

Turning now to the drawings, FIG. 1 shows an expanded view of a connector of a type of interest in the practice of the invention described in U.S. Pat. No. 3,930,705 incorporated in this application by reference. As shown, the exemplary connector includes a receptacle 1 and a plug 2, each of which includes a region 4 which may be referred to as a peripheral retaining shoulder. FIG. 8 is a view of an assembled connector with a plug 1 seated in a receptacle 2 with peripheral retaining shoulders 4 aligned as indicated. The line at J represents the joint between plug 1 and receptacle 2. When the joint J is closed, the design of the plug and the connector is such that contacts therein will make good electrical connections. The peripheral retaining shoulders 4 are arranged so that they may be used, in a mating clip according to the invention, to gauge whether the joint J is properly closed without requiring close optical inspection. The shoulders 4 may also be used in conjunction with suitable retaining means, forming a part of the inventive mating clip, to maintain the joint and therefore the connector in a closed condition following assembly of the clip to a connector.

Figure 2:
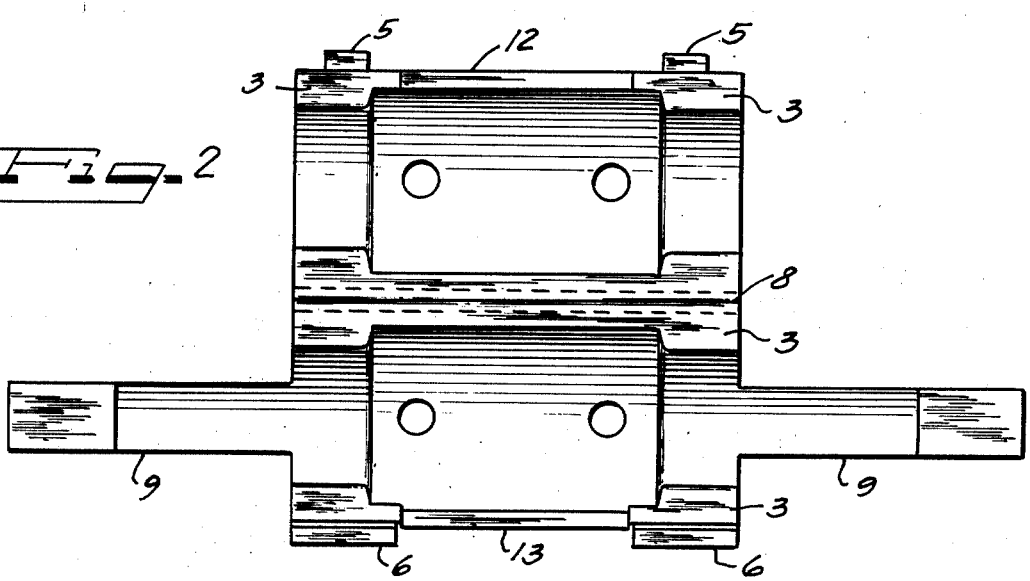
FIG. 2 shows a mating clip, according to the invention, as it appears in its open position before a connector is inserted.

FIG. 2 shows a mating clip of semi-rigid plastic in an open position ready to receive a mated connector. In this Figure, 12 and 13 are halves of a cylinder, or tube, which are interconnected by a flexible web at 8 that functions as a hinge. The hinge makes it possible to shift the alignment between 12 and 13 by 180 degrees. This capacity for change in relationships between segments 12 and 13 allows the segments to be arranged adjacent and parallel to each other as semi-cylindrical objects in what may be called the open position of FIGS. 2, 3 and 4. It also permits them to form a full cylindrical, or tubular, arrangement when the upper segment 12 is rotated about the hinge 8 to a rest position against the lower segment 13 in what may be called the closed position of the clip as shown in FIGS. 5, 6 and 7.

Associated with each segment of the clip in FIG. 2 are a plurality of tapered retaining shoulders 3 which are provided to mate positively in an interference fit with connector peripheral retaining shoulders 4, shown in FIGS. 1 and 5. Elements 5 in FIG. 2 are male interlock means which are provided to lock into female interlock means at 6 when the clip connector is in its closed position. Strain relief beams 9 are shown as integral parts of the mating clip. The relief beams may be used with tie wraps to give added protection to electrical wiring and cables as is explained below in connection with FIGS. 5 and 6.

Figure 3:
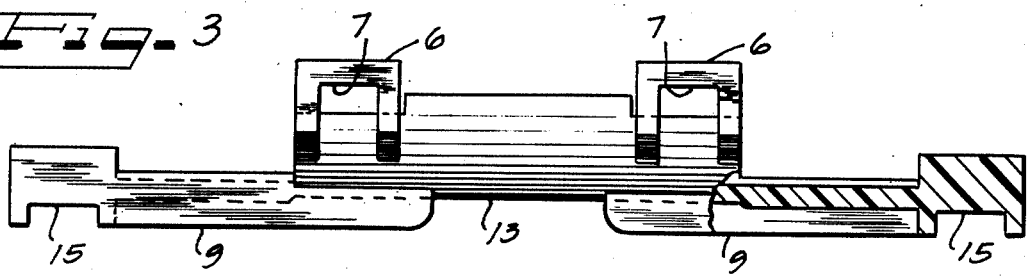
FIG. 3 is a side view of the clip shown in FIG. 2.

FIG. 3 is a side view of the mating clip of FIG. 2 illustrating additional details of the clip molded of a generally rigid or semi-rigid plastic such as a polycarbonate. It will be seen that the female interlock means 6 includes a window 7. This window is accessible to the male interconnect means 5 and enables a lock to be established between interlock means 5 and 6. The strain relief beams 9 are shown to include undercut sections at 15 which receive and retain tie wraps when electrical wiring or a cable is supported by relief beam.

Figure 4:
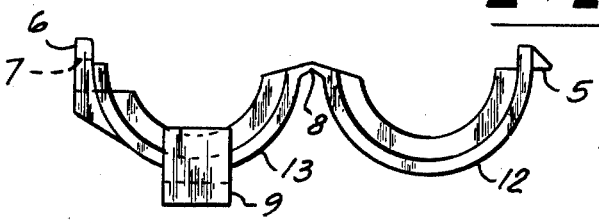
FIG. 4 is an end view of the clip shown in FIG. 3.

FIG. 4 is an end view of the mating clip of FIG. 3 illustrating details of construction of a preferred embodiment. From this view the semi-cylindrical, or semi-tubular, nature of the clip parts 12 and 13 will be clearer as is the fact that 12 and 13 are interconnected by a hinge 8 which is integral to them. From this view, too, it will be clearer how the male interlock means 5 fits into the window 7 of the female interlock means 6 to secure the mating clip in its closed position. As indicated, the elements 5, 6, 8, 9, 12 and 13 are integral to each other, but it will be recognized that they may be assembled together as individual parts, if desired.

FIG. 5 is a view of a mating clip in its closed position to secure a mated connector formed by a plug 1 and a socket 2. In this view the segment 12 of the mating clip is visible together with a hinge 8, relief beams 9, interlock means 5, 6, a connector 1, 2, electrical wiring 10 and a tie wrap 11.

FIG. 6 is a side view in partial section of FIG. 5. FIG. 6 shows a connector mating clip which is secured in its closed position by means of the interlocking members 5 and 6. It will be seen that the female interlock means 6 is located on the lower partial cylinder 13 and is comprised of a double cantilever beam and crossmember forming a window 7 to accept a mating male member 5 which protrudes at a corresponding point from the upper partial cylinder 12. At the point of closure, sufficient force is applied to the upper and lower elements 12 and 13 to cause the female member 6 to deflect allowing the male member 5 to enter the window 7 formed by the female member.

With the male member 5 in position in the window 7, the female member 6 recovers to its approximate original position confining the male member and preventing the segments 12 and 13 from separating. The locking members 5 and 6 may be released and the segments 12 and 13 may be returned to the open position by inserting a hand tool, such as a screwdriver, between the female member 6 and the segment 12 causing the female member to deflect and release the male member 5 from the locking window 7.

With the mating clip in the open position of FIGS. 2, 3, 4, an electrical connector comprised of a mated plug 2 and receptacle 1 may be nested in either of the segments 12 or 13. To this end, the plug and connector each have peripheral retaining shoulders 4 which may be nested adjacent to and within the limits of corresponding tapered retaining shoulders 3 located in the segments 12 and 13.

Dimensional relationships between the mated connector pair 1 and 2, the peripheral retaining shoulders 4 and the mating clip retaining shoulders 3 are chosen such that a connector pair which is not fully mated will not nest within the limits of the mating clip retaining shoulders 3 due to excessive axial length across the connector pair retaining shoulders 4. This arrangement thereby prevents complete assembly of the mating clip with the connector pair and thereby indicates that the connector members 1 and 2 have not been fully mated.

When a correctly mated connector pair 1 and 2 is nested in either segment 12 or 13, the mating clip may be closed and locked to form a protective cylinder or shell around the connector mated pair thereby preventing excessive failure or bending of connector bodies 1 and 2 which might damage electrical contacts. With complete closure of the mating clip, the retaining shoulders 3 of the segments 12 and 13 provide positive 360 degree interfaces with the mating shoulders 4 of the connector mated pair 1 and 2. These 360 degree interfaces constitute interference fits between the tapered shoulders 3 and straight shoulders 4 which prevent accidental uncoupling of the connector due to shock, vibration or axial loading of electrical wiring such as that indicated at 10.

A strain relief beam 9 may be supplied to provide strain relief to electrical wiring such as that at 10. The beam 9 may project from the outer radius of the lower segment 13 and extend axially outward from each end of segment 13. The beam is intended to prevent a wire such as 10 from being laterally loaded which could cause critical connector wire seals 14 to be distorted and become non-functional. An undercut 15 in the strain relief beam 9 is provided to accomodate a commercial plastic tie 11 which mechanically confines the electrical wire 10 to the strain relief beam 9.

FIG. 7 is an end view of an assembly according to FIG. 6. In this view additional aspects of an exemplary assembly will be clear. Particular relationships between wiring 10, the plug 2, the strain relief beam 9 and the tie wrap 11 are shown. In addition, it will be clearer how the male interlock means 5 and the female interlock means 6 are coupled. Also, it will be apparent that by inserting a screwdriver or other tool between the semi-cylinder 12 and the female means 6 leverage may be provided to enable the interlock means 6 to be pushed away from contact with the interlock means 5, thereby releasing the segments 12 and 13 so that they may be restored to their open position, as in FIG. 2.

FIG. 8 shows an embodiment of section 12 in accordance with the invention in which a connector formed by a socket 2 and plug 1 has been inserted in the section 12. The tapered shoulders 3 engage the peripheral retaining shoulders 4 of the connector mated pairs 1 and 2. The taper in the shoulder 3 is such that the shoulders 3 press against the shoulders 4 providing a positive fit between 3 and 4 which constitutes an interference fit which enables the mating clip to keep the connector closed and maintain good electrical contacts.

As represented by shoulders 3 in FIG. 5, of the retaining means for retaining mated connector members includes surfaces spaced for interfitting with the mated connector members whereby it is possible to determine whether the members forming the connector are mated or not. Shoulders 3 advantageously include radial surfaces with tapers to develop pressure in a mating direction between the connector members further preventing movement of the connector members in an unmating direction. In FIG. 7, the conductors extending from the connector members lead to contacts as shown in the above-identified U.S. Pat. No. 3,930,705 with at least one pair of the contacts disposed along a longitudinal axis generally parallel to the longitudinal axis of the connector member and inserts for housing those contacts have outer retention surfaces spaced along the axis. The mating clip includes an axially extending body member of generally rigid construction extending over an outer portion of each connector member for supporting the members against extreme lateral flexing. The body member includes connector retaining means including surfaces spaced apart axially a predetermined distance for engagement with the retention surfaces of the connector members for preventing axial displacement of the members in a nonmating direction. Means are provided for holding the body member firmly against the connector members and the surfaces of the retaining means against the insert retention surfaces. Advantageously beam members as shown in FIGS. 6 and 7 are intragally formed on the body member and extend axially beyond the connector members for providing strain relief to conductors affixed to the connector members.

While the principles of the invention have been described above in connection with specific apparatus and applications, it is to be understood that this description is made only by way of example and not as a limitation on the scope of the invention.

I claim:

1. A mating clip for retaining in a properly assembled and mated relation connector members having at least one pair of mated contact members disposed along a longitudinal axis and surrounding housing portions with outer retention surfaces spaced along said axis, comprising:

an axially extending body having open and closed states and extending in a closed state over an outer portion of each connector member for supporting said members, said body including angled retaining shoulders of semi-rigid material for engaging said outer retention surfaces of said connector members in closing said body about said connector members to urge said connector members toward a properly mating relation.

2. The mating clip of claim 1 including latch elements substantially aligned with said retaining shoulders for latching when said body member is in its closed state, said latch elements resisting radially outward expansion of said body upon applying axial loading to said connector members.

3. The mating clip of claim 1 including beam members integrally formed on said body member and extending axially beyond said connector members for providing strain relief to conductors affixed to said connector members.

4. The mating clip of claim 1 in which said retaining shoulders are inwardly opposed radial shoulders preventing axial displacement of said connector members.

5. The mating clip of claim 1 in which said body is generally cylindrical and said outer retention surfaces are circumferential grooves.

6. The mating clip as claimed in claim 5 in which said body is generally cylindrical in said closed state, and said angled retaining shoulders are inwardly opposed radial shoulders.

7. The mating clip as claimed in claim 6 in which said shoulders are spaced apart axially a distance generally equal to the distance between said circumferential grooves.

8. The mating clip of claim 7 in which each of said shoulders has a width generally equal to the width of the corresponding one of said grooves.

9. A mating clip for retaining a connector composed of mating connector members each having retaining shoulders at predetermined spaced locations in a properly assembled and mated relation, comprising:

a body composed of mating half-sections joined at a hinge point and having an open state in which said body is available to receive said connector, said body including retaining means composed of a pair of spaced sloping shoulder portions extending substantially entirely about said connector members to make a positive interference fit with said retaining shoulder portions on said mating connector members only when said connector members are properly mated and with said sloping shoulder portions of said retaining means tending to urge said connector members toward a properly mating relation, said body having a closed state in which said retaining means in said body is able to retain said connector, and means for securing said body in its closed state.

10. The mating clip of claim 9 in which said body and said retaining means are formed of semi-rigid material, whereby said body and said retaining means provide protection for a flexible connector against bending as well as preventing movement of a flexible connector along an axis through the center of said body.

11. A mating clip for receiving and retaining mating connector members in a properly assembled and mated relation, comprising:

a body having open and closed states, retaining means associated with said body including spaced angled retaining shoulders extending substantially entirely about said mating connector members for engaging said mating connector members and spaced latching means including latch elements in predetermined alignment with said spaced retaining shoulders for latching when said body is in its closed state and being secured against unlatching upon application of a force tending to shift said body from its closed to its open state, said retaining means functioning when said body is in an open state to receive said mating connector members only in a properly assembled and mated relation, and said retaining means functioning when said body is in a closed state to form an interference fit with said mating connector members thereby developing a force tending to shift said body from its closed to its open state.

12. The mating clip of claim 11 in which said body includes a hinge and a pair of sections supported by said hinge, said hinge providing means about which said sections of said body may be opened and closed.

13. The mating clip of claim 11 in which said body is formed of semi-rigid plastic and said body in its closed state provides a rigid support for said connector members to prevent said connector members from bending.

* * * * *